US007590373B2

(12) United States Patent
Hebner et al.

(10) Patent No.: US 7,590,373 B2
(45) Date of Patent: Sep. 15, 2009

(54) TONER METERING APPARATUS

(75) Inventors: JoAnn Whitney Hebner, Lexington, KY (US); Royden Thomas Kern, Lexington, KY (US); David Lee Merrifield, Lexington, KY (US); Asmund Vego, Lexington, KY (US)

(73) Assignee: Lexmark International, Inc, Lexington, KY (US)

( * ) Notice: Subject to any disclaimer, the term of this patent is extended or adjusted under 35 U.S.C. 154(b) by 366 days.

(21) Appl. No.: 11/682,908

(22) Filed: Mar. 7, 2007

(65) Prior Publication Data

US 2008/0219709 A1 Sep. 11, 2008

(51) Int. Cl.
*G03G 15/08* (2006.01)

(52) U.S. Cl. ..... 399/258; 399/260; 399/263

(58) Field of Classification Search ..... 399/27, 399/258, 259, 260, 262, 263
See application file for complete search history.

(56) References Cited

U.S. PATENT DOCUMENTS 5,012,289 A 4/1991 Aldrich et al.
5,101,237 A 3/1992 Molloy
6,510,291 B2 * 1/2003 Campbell et al. ..... 399/27
7,152,322 B2 12/2006 Nakashima et al.
7,389,072 B2 * 6/2008 Hebner et al. ..... 399/260
2006/0023055 A1 2/2006 Castle et al.
2006/0182475 A1 8/2006 Gopalanarayanan et al.
2006/0257171 A1 11/2006 Askren et al.
2006/0263105 A1 11/2006 Able et al.

* cited by examiner

*Primary Examiner*—Hoang Ngo

(57) ABSTRACT

The present disclosure relates to a device and/or method for conveying a quantity of image forming material between selected regions in a printing device or printer cartridge. A roller is provided having a surface that may include a recess capable of transferring a quantity of image forming material. The recess may include a convex surface. A wiper is configured to engage at least a portion of the roller surface and/or the convex surface in the recess to assist in the removal of image forming material that may otherwise accumulate on the roller surfaces. Such roller design and wiper configuration may therefore cooperate to improve the consistency of image forming material transfer.

20 Claims, 7 Drawing Sheets

TONER METERING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1 . Field of Invention

The present disclosure relates to the transfer of image forming material, such as toner, within an image forming apparatus. More particularly, the present disclosure relates to an apparatus and method for removing accumulated toner from a roller that transfers toner from a first region to a second region within an image forming device or an image forming device cartridge.

2 . Description of the Related Art

An image forming apparatus, such as an electrophotographic device, ink printer, copier, fax, all-in-one device or multi-functional device may use developing agents such as toner or ink, which may be disposed on media to form an image. The developing agent, such as toner, may be fixed to the media using an image fixing apparatus, which may apply heat and/or pressure to the toner. In a developer assembly in an image forming apparatus, a toner meter roller may be used to convey toner from an upper sump to a lower sump in a cartridge. However, there remains a need to provide a supply of toner in a relatively more consistent manner which may then reduce starvation of toner to the developer roller which is in contact with the photoconductive drum and/or allow a relatively more accurate estimate of toner consumption.

SUMMARY OF THE INVENTION

The present disclosure relates to a device and/or method for transferring a quantity of image forming material between selected regions in a printing device or printer cartridge. A roller may be employed having a surface that may include a recess capable of transferring a selected quantity of image forming material. The recess may include a convex surface. A wiper is configured to engage at least a portion of the roller surface and/or a surface in the recess to assist in the removal of image forming material. Such roller design and wiper configuration may therefore cooperate to improve the consistency of image forming material transfer.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings wherein.

DETAILED DESCRIPTION

Figure 1:
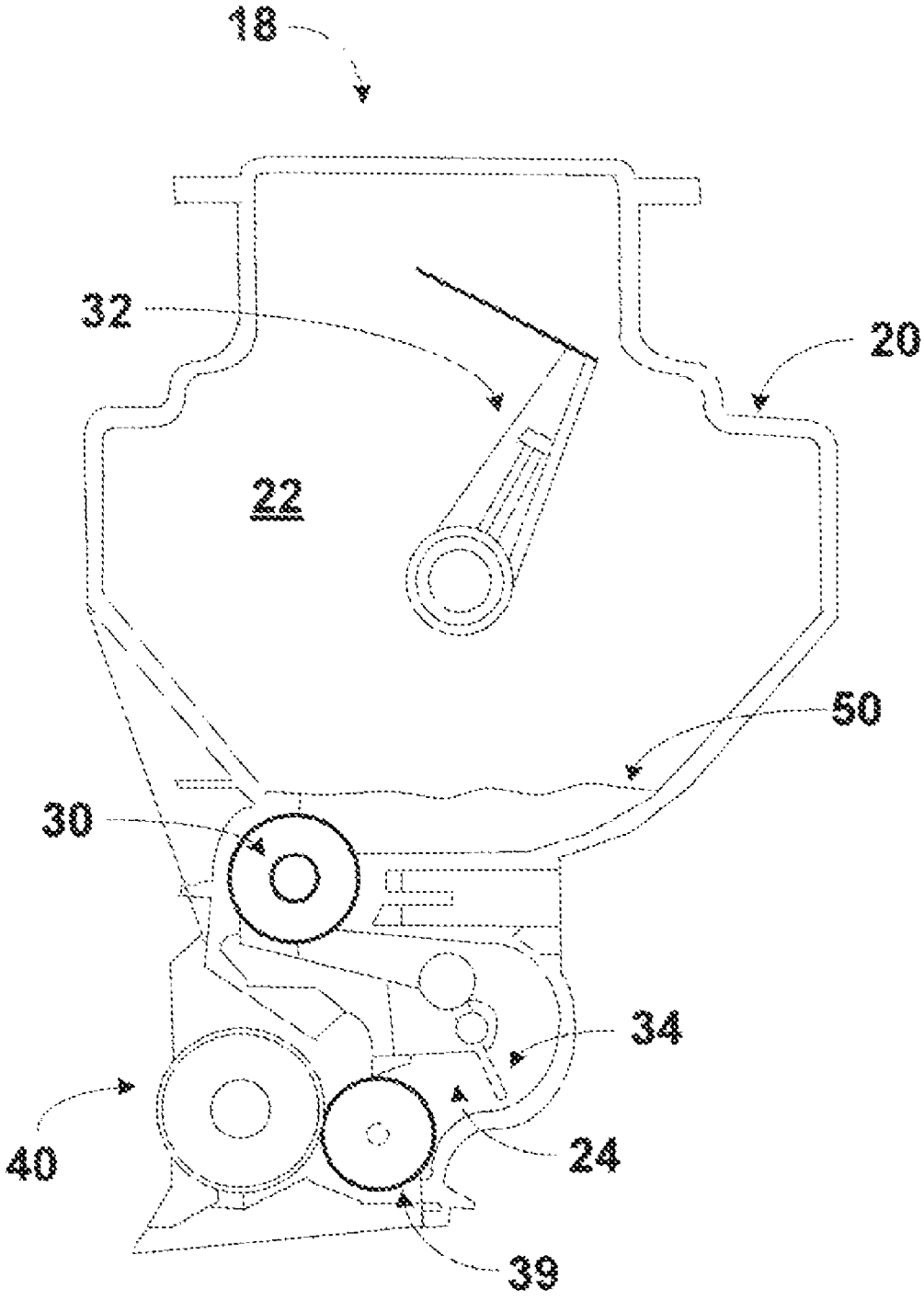
FIG. 1 is a sectional view of an exemplary developer cartridge for an electrophotographic device.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

As shown in sectional view in FIG. 1 an exemplary developer assembly such as a cartridge 18 for an electrophotographic device may include a housing 20 which may comprise an upper sump 22 and lower sump 24 for supplying image forming material, such as toner 50, to a toner adder roller 39 which in turn supplies toner to developer roller 40. The developer roller 40 may then supply toner to a photoconductive drum which is not shown for clarity. A toner meter roller 30 may be placed between the sumps. The toner meter roller 30 may then provide a relatively more consistent supply of toner to the lower sump when the system calls for toner. The upper sump 22 and lower sump 24 may also include paddles or agitators 32 and 34, respectively, for agitating and assisting in dispensing the toner 50.

The toner meter roller 30 may specifically be used to regulate toner consumption when monitored by associated hardware/software concerning the number of revolutions over a given period of time. For example, it may be assumed to a first approximation that the amount of toner delivered in one rotation of the roller is relatively consistent when evaluating toner consumption. However, if the toner 50 used varies in its bulk flow characteristics, toner may periodically accumulate and collect on the surface of the roller 30. The result may then be starvation of the developer roller and poor print quality and/or an incorrect determination of the amount of toner that may have been consumed. It may be noted that toner bulk flow characteristics may be understood as the flow of the solid toner, which may depend upon such variables as toner average particle size and/or particle size distribution, toner composition, toner geometry and/or circularity, environmental considerations, as well as the design and operation of the developer assembly in which the toner may ultimately be contained.

Figure 2:
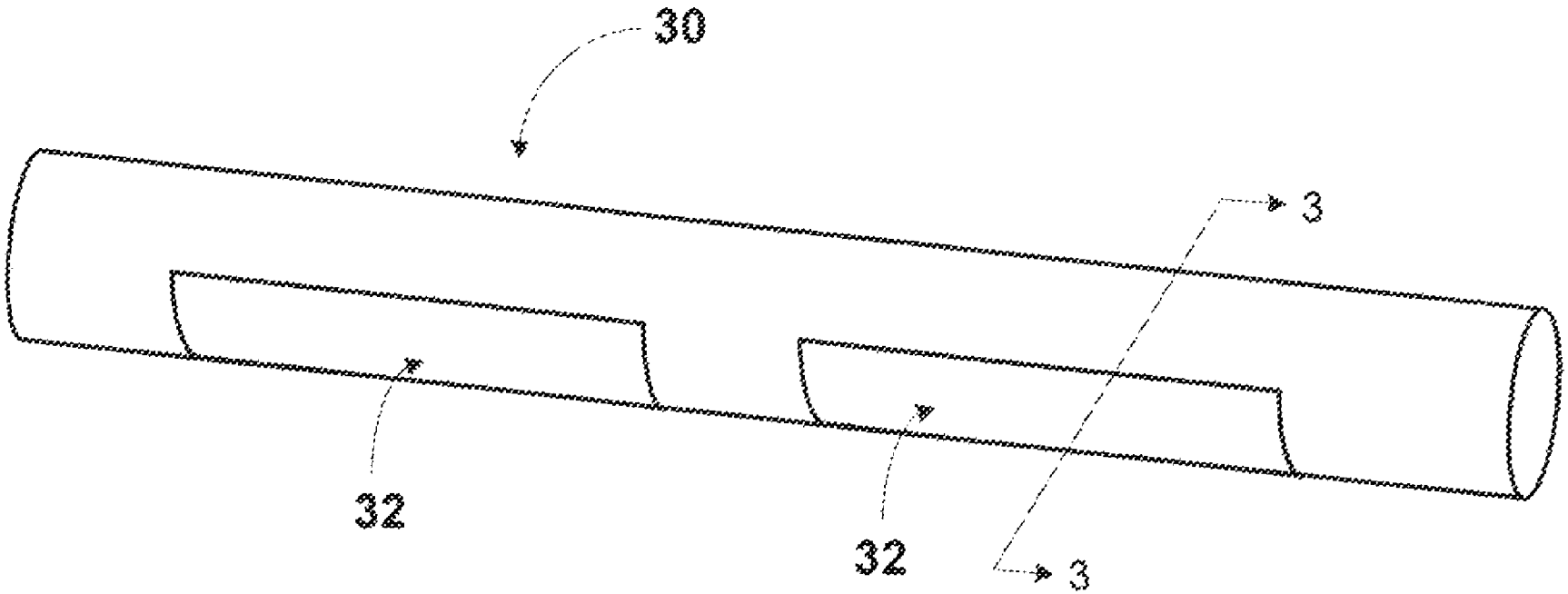
FIG. 2 is a perspective partial view of a toner meter roller including one or more recessed regions in the roller surface.

As shown in FIG. 2, the toner meter roller 30 may be a generally cylindrical device which may include one or more regions 32 that may define a recess relative to the roller surface. As illustrated, these recessed regions may be aligned along one side of the roller, but other alignments are contemplated herein about the entire 360 degree circumferential surface of the roller.

Figure 3:
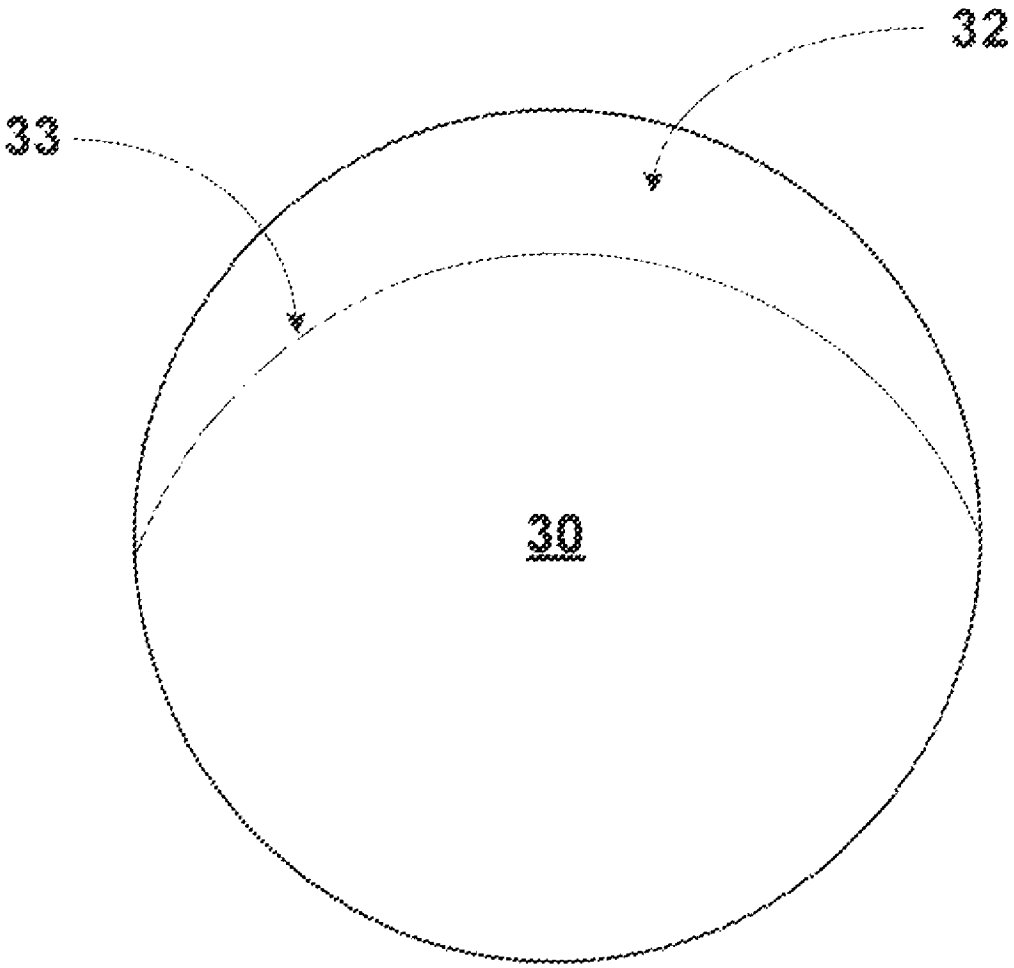
FIG. 3 is a relatively enlarged view of the roller of FIG. 2 along line 3-3, illustrating the use of a convex surface in the roller recessed regions.

A recess in the roller surface may therefore be understood as an area set into the roller surface, such as an indented or hollowed-out space, that may accommodate a desired amount of toner. For example, recessed regions 32 may assume the general shape of a pocket and may include one or more surfaces therein, such as a convex surface. The regions 32 may then assist in the delivery of toner from, e.g., the upper sump 22 to the lower sump 24. FIG. 3 therefore provides a relatively enlarged cross-sectional view of the roller along lines 3-3 of FIG. 2. As can be seen, the regions 32 may include what may be described as a lower convex surface 33. In one exemplary embodiment, the radius of the roller may be about 8.4 mm and the radius of the recess may be about 20 mm. This provides a ratio of (20 mm/8.4 mm) of at least about 2.4 or higher. It is therefore contemplated herein that the convex surface 33 may have about the same radius of curvature of the roller 30. Accordingly, the present disclosure applies to a roller having a given radius of curvature (Rc), where the region 32 may include a lower convex surface that provides a radius of curvature of about (0.75 to 5.0)Rc. Such regulation of the curvature of the roller relative to the curvature of convex surface 33 may then facilitate relatively smoother engagement with a wiper upon rotation of the roller, as discussed more fully below.

Accordingly, it may now be appreciated that in an exemplary toner meter roller, the roller may be configured and be capable of transferring about 0.1-5.0 grams of toner per revolution, including all values and increments therein. For example, the toner meter roller may transfer about 1.0 to about 2.0 grams per revolution. More specifically, and again by way of example, it has been found that for a specific toner meter roller containing two recessed regions 32, each region may transfer about 0.6 grams of toner per revolution to the lower sump. Accordingly, for each revolution of such toner meter roller, a total of 1.2 grams of toner may be expected to be delivered to the lower sump, in the absence of any toner accumulating on the roller surface which would then reduce the roller's overall efficiency of toner transfer.

Figure 4:
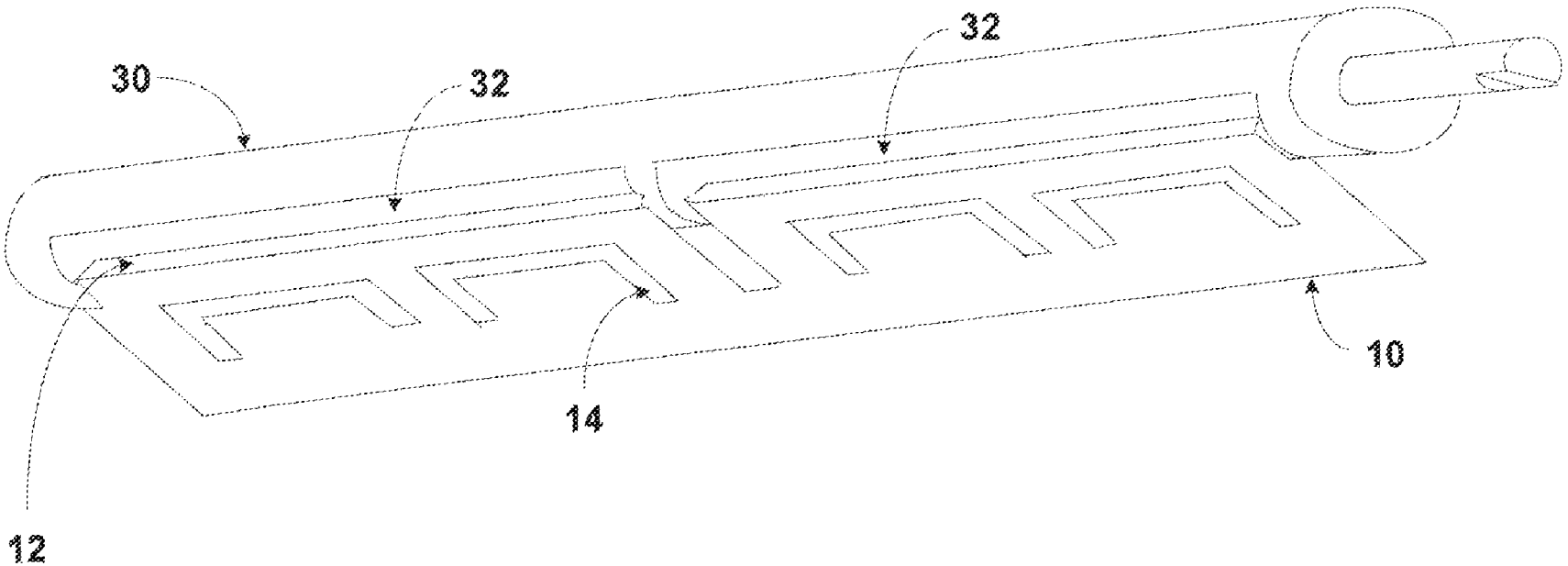
FIG. 4 is a perspective view of the exemplary roller engaged with a wiper.

The recessed regions 32 are further illustrated in FIG. 4 which identifies the general positioning and engagement of a wiper 10 with roller 30. The wiper 10 may be fixed at any convenient location within the developer assembly so that upon rotation of the roller 30 the wiper may engage with the roller to assist in reducing the amount of toner that may otherwise have collected on the roller surface as opposed to being transferred to lower sump 24. As noted above, such accumulation of toner on the roller may be due to a variety of physical and/or chemical characteristics of the toner that may interfere with toner bulk flow capability within a given electrophotographic printing device.

With attention still directed at FIG. 4, it can be seen that the wiper 10 may desirably extend along nearly the entire length of roller 30 and include a plurality of portions (e.g., two portions as shown) where each portion may be configured to engage with regions 32. Accordingly, for a given roller having a given length, the wiper 10 may extend along about 90% or more of such length and also be biased against the roller surface and be designed to travel through the pocket regions 32 upon roller rotation, with continued and relatively constant biasing engagement.

The wiper 10 may also include openings 14. Such openings may therefore serve to reduce the potential for accumulation of toner on the wiper 10. Such accumulation of toner might otherwise ultimately stress the attachment points of the wiper to the housing. For example, the wiper 10 may be adhesively or mechanically attached to the housing by various conventional techniques. The openings 14 may therefore assume a variety of sizes and shapes that extend across the surface of the wiper 10 as currently illustrated, but not otherwise interfere with the flexibility and generally elastic nature of the wiper to remain biased against the roller. As also shown in FIG. 4, the openings 14 may include a plurality of generally "U" shaped type openings, and other types of opening designs, e.g. "L" shape, "T" shape "S" shape or "Z" shape are contemplated herein.

In addition, the wiper 10 may include a generally upstanding flange portion 12 which may engage with the roller 30 as shown and in particular, as illustrated in FIG. 4, engage within the pockets 32 and the convex surface 33 that may be present therein. In such manner it may now be appreciated that the present disclosure provides for a developer system wherein the wiper 10 may substantially clean the roller 30 and/or regions 32 upon each and every revolution such that toner is more reliably delivered to lower sump 24. It may therefore be appreciated that with respect to a given roller herein for transferring toner between a first region (e.g. upper sump) to second region (e.g. lower sump), wherein the roller is capable of transferring a given theoretical average quantity of toner per revolution ($Q_{rev}$), the use of the wiper herein provides that the actual quantity of toner transferred per revolution may not vary more than about +/−20%, including all values and increments therein. It may therefore be appreciated that the theoretical average quantity of toner that may be transferred may be readily determined by a consideration of the recess dimensions (i.e. available recess volume) and its ability to contain an average charge (in weight) of toner material. Accordingly, the actual amount of image forming material or toner transferred per revolution ($T_{rev}$), due to the use of the wiper, may now be equal to about (0.80-1.20) ($Q_{rev}$), including all values and increments therein.

Figure 5:
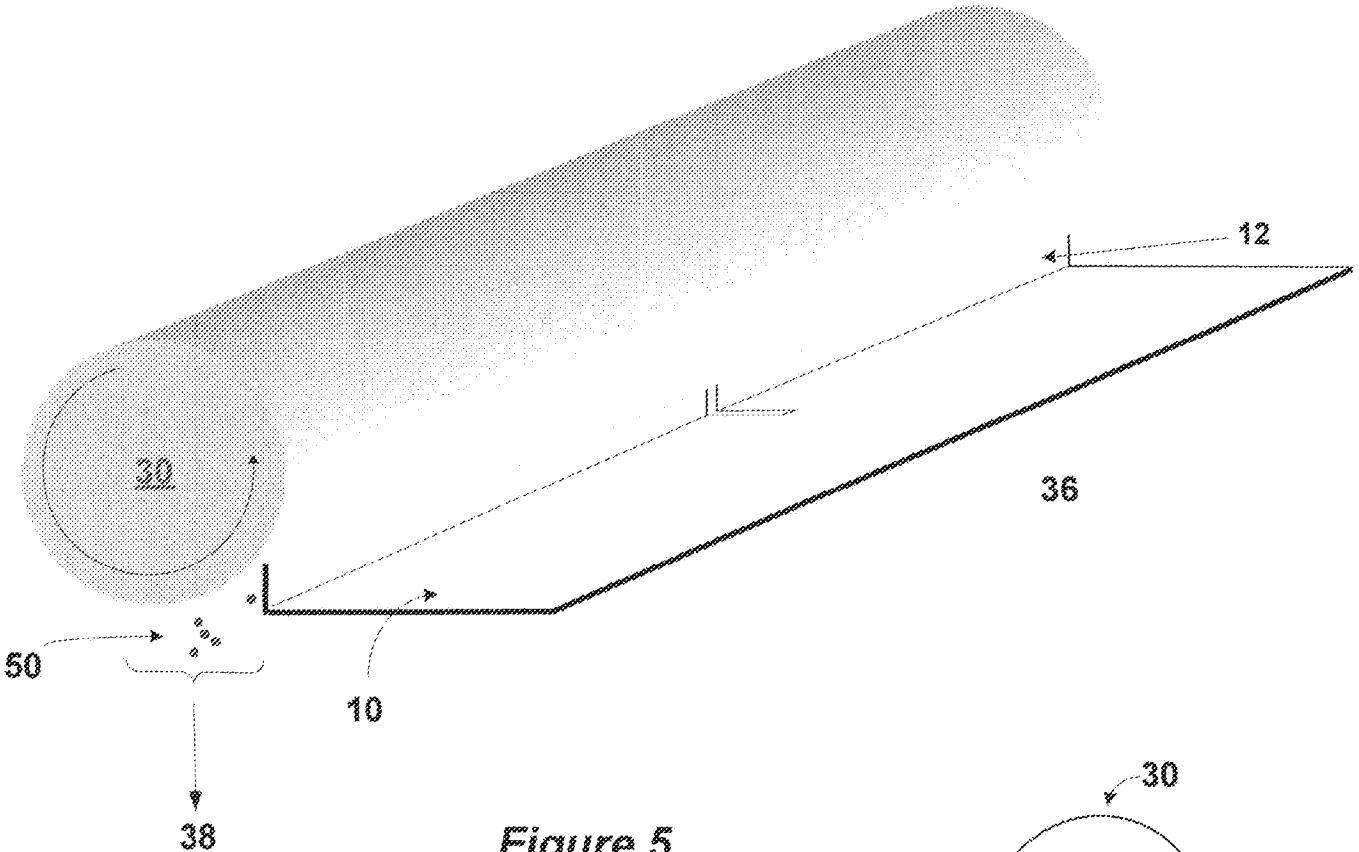
FIG. 5 is another perspective view of a roller engaged with a wiper.
Figure 5A:
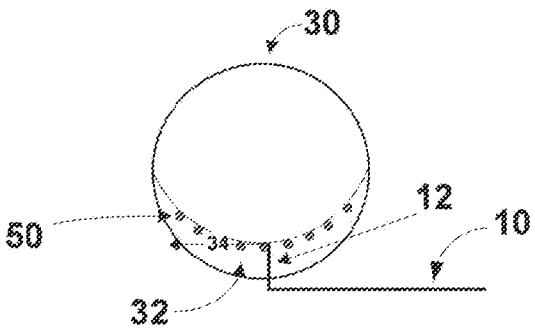
FIG. 5A is a cross-sectional view of the roller illustrating generally the push force vector of a wiper with a roller.

Furthermore, due to the presence of flange portion 12 it may be appreciated that as the wiper travels across the surface of roller 30, it may provide a relative push type shear force vector to any accumulated toner and effectively remove/scrape toner form the roller surface. With attention to FIG. 5, roller 30 may be seen at a given point in its revolution, engaged with wiper 10 in which flange portion 12 is engaged in a recess 32 (not shown) so that the flange portion is not fully visible. The rotation may be counter-clockwise as illustrated. However, in the broad context of the present disclosure, clockwise rotation is also contemplated. Particles of toner 50 can also now be seen that have been removed from the roller surface and therefore allowed to transfer to the lower sump as shown generally by arrow 38. FIG. 5A illustrates in cross-section the general location of a shearing type push force vector relative to the surface of the rotating roller 30, as indicated by arrow 34. Accordingly, it may be appreciated that a shearing type force to the roller surface may be understood as any force that results in movement of the toner away from the surface of the roller as opposed to an exclusively normal or perpendicular force that may otherwise compress the toner against the roller.

The wiper 10 may be formed from a variety of materials. When selecting a material for wiper 10, and as one of several possible considerations, it may be useful to recognize that type of material that will not otherwise damage or actually remove or scrape roller material from the roller surface. As can be appreciated, this then may contaminate the toner within the cartridge. Accordingly, it is contemplated herein that for a roller material with a given Shore or Rockwell Hardness value, the wiper 10 may initially be selected from a material with a relatively lower value which may then assist in reducing the development of toner contamination over time within a given printing device. In that regard it may be appreciated that typical material utilized for roller 30 includes high impact polystyrene (HIPS) which may have a Rockwell Hardness value of between about 65-95R, depending upon the proportion of the resins (typically diene rubber and polystyrene) present in the material.

The wiper may therefore be formed from a variety of materials and assume a number of specific constructions, some examples of which are now shown in FIGS. 6A-6B and 7A-7B. In the exemplary embodiment first provided in end view in FIG, 6A and perspective view in FIG. 6B, the wiper 10 may be formed from metal, such as stainless steel, having a thickness of about 1-3 mils, including all values and increments therein. The wiper may therefore be formed with an integral upstanding metallic flange 12. Accordingly, such integrally formed wiper may be understood to be of unitary construction. In addition, as noted above, one or more openings 14 may be formed in the body of the wiper so as to reduce an accumulation of toner on the wiper when used in a given printer. In addition, as can be seen, the upstanding flange 12 may initially define a perpendicular angle when intersecting with the body of the wiper 10, as shown generally by arrow 40. However, this particular angle may also vary between about 45-135 degrees, including all values and increments therein.

Figure 6B:
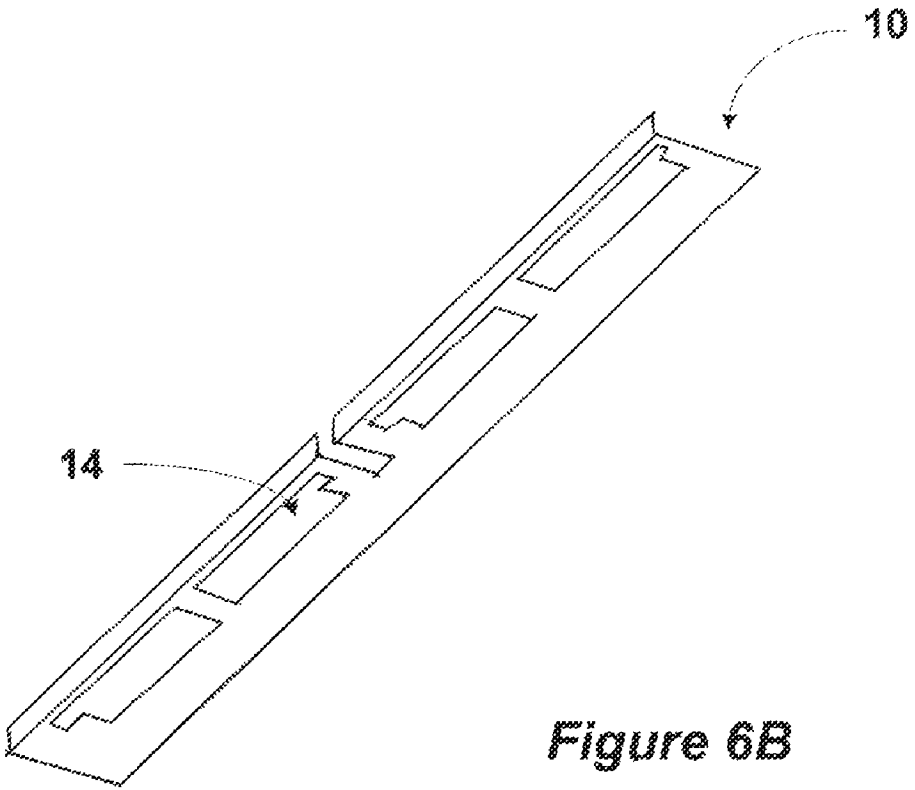
FIG. 6B is a perspective view of a wiper of unitary construction.
Figure 6A:
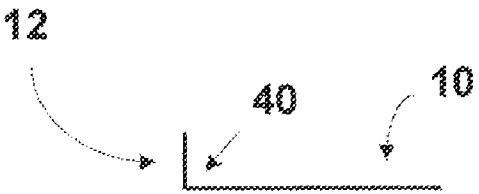
FIG. 6A is a cross-sectional view of an exemplary wiper illustrating the angle of engagement of the upstanding portion flange portion with the wiper body.

In addition, the integral formed wiper shown in FIGS. 6A and 6B may be sourced from a polymeric material, such as a thermoplastic or thermoset type material. For example, the wiper may be formed from a sheet of extruded thermoplastic polyester MYLAR® film available from DuPont, at about 3-20 mils thickness including all values and increment therein. In one specific embodiment the wiper may therefore be formed from a sheet of MYLAR® of about 10 mils in thickness along with an integrally upstanding flange. Accordingly, the wiper 10 may be formed from other thermoplastics including polyesters, polycarbonates, polysulphones, rigid vinyl (PVC), etc. It may also be formed from thermoplastic elastomers, including polyurethane or polyester type elastomers.

Figure 7B:
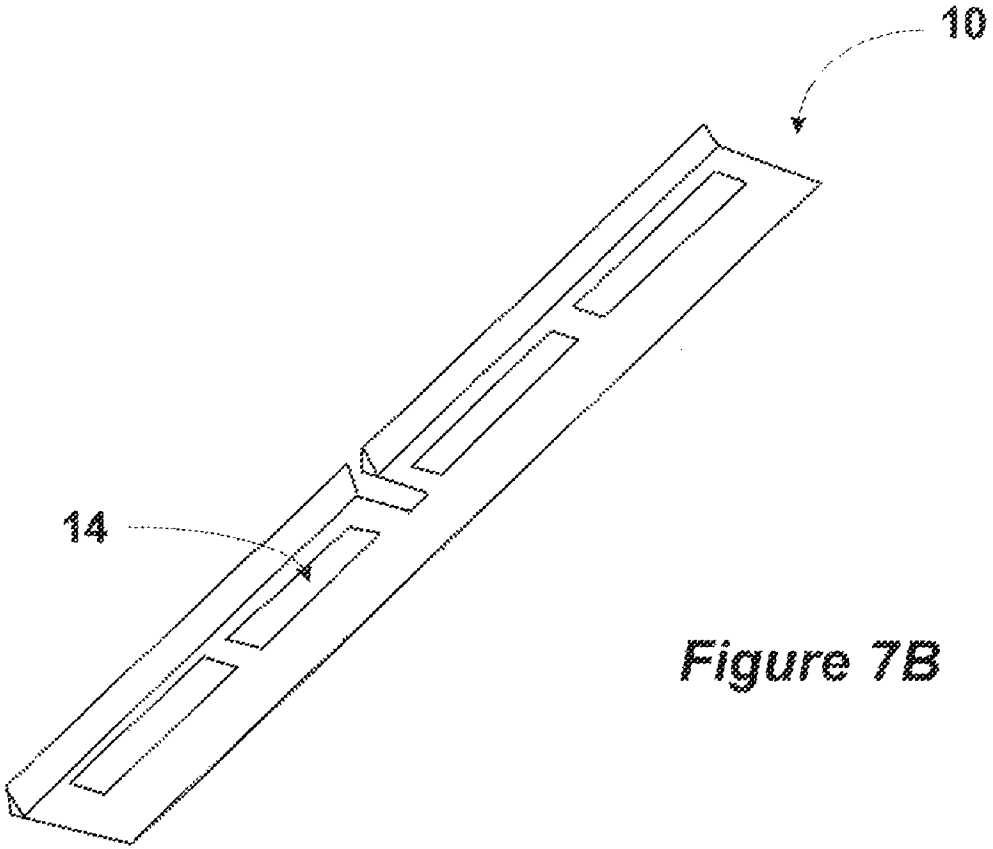
FIG. 7B is a perspective view of a wiper of non-unitary construction.
Figure 7A:
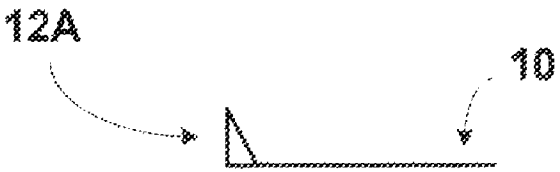
FIG. 7A is a cross-sectional view of an exemplary wiper of non-unitary construction showing the placement of an upstanding flange portion.

In another exemplary embodiment, as shown in end view in FIG. 7A and in perspective view in FIG. 7B, the wiper 10 may be formed of one or even a plurality of different materials. For example, the body of the wiper (i.e. that portion of the wiper other than the flange 12) may be formed from the polyester sheet material noted above such as MYLAR®. Accordingly, the body portion of the wiper 10 that serves to provide a biasing force against the roller may be formed from a material that provides substantial elastomeric and flex/recovery characteristics, alone with minimized creep (strain v. time behavior) in order to optimize the ability to remain in force-contact against the roller over the lifetime of a given cartridge.

Attached to the body, by way of an appropriate adhesive or even mechanical attachment, may then be a triangular section 12A. The triangular portion 12A may therefore comprise the same or even a different polymer from the body. For instance, a polyacetal polymer such as DELRIN® from DuPont may be employed to form triangular portion 12A. It can therefore be appreciated that the triangular portion 12A may be selected to provide durability over time with respect to a consideration of its frictional engagement to a given roller surface. For example, with respect to the exemplary polyacetal material, it may be appreciated that such material may provide a static coefficient of less than or equal to about 0.20, or a dynamic coefficient of friction of less than or equal to about 0.35 . Such characteristics may therefore afford extended cleaning capability to remove accumulate toner. Other materials which may provide relatively low frictional engagement with the roller may include various other thermoplastics, e.g., polyamides, polysulphones, polyesters, ABS, etc.

As alluded to above, each of the exemplary wipers described herein as shown in FIGS. 6A, 6B, 7A and 7B may include one or more openings 14 of varying design geometry to minimize collection of toner that may otherwise stress the attachment points (mechanical or adhesive) of the wiper 10 to the housing. In addition, it should be appreciated that with respect to any and all of the embodiments herein, the various features are to be understood as completely interchangeable and not necessarily limited to the particular embodiment shown and described.

The foregoing description of several methods and an embodiment of the invention have been presented for purposes of illustration. It is not intended to be exhaustive or to limit the invention to precise steps and/or forms disclosed, and obviously many modifications and variations are possible in light of the above teachings. It is intended that the scope of the invention be defined by the claims appended hereto.

What is claimed is:

1. A device for transferring a quantity of toner material between first and second regions in a printer comprising:

a roller having a surface including one or more recesses capable of transferring an average quantity of image forming material for each revolution of said roller ($Q_{rev}$) between said first and second regions;

a wiper configured to engage at least a portion of said roller surface;

wherein said wiper provides that the amount of toner material transferred per revolution ($T_{rev}$) is equal to about 0.8-1.2($Q_{rev}$).

2. The device of claim 1 wherein the amount of toner material transferred per revolution ($T_{rev}$) is equal to about 0.9-1.1($Q_{rev}$).

3. The device of claim 1 wherein said roller has a radius of curvature (Rc) and said recess includes a convex surface having a radius of curvature that is equal to about (0.75-5.0) (Rc).

4. The device of claim 1 wherein said recess includes a recess surface and said wiper includes a body and upstanding flange wherein said upstanding flange engages with at least a portion of said roller surface and a portion of said recess surface.

5. The device of claim 1 wherein said wiper has a body portion including one or more openings in said body portion.

6. The device of claim 4 wherein said wiper is of unitary construction.

7. The device of claim 4 wherein said wiper is of non-unitary construction.

8. The device of claim 1 wherein said device is positioned in a printing device.

9. The device of claim 1 wherein said device is positioned in a printer cartridge.

10. A cartridge for a printer comprising:

a housing including first and second regions for containing image forming material;

a roller having a surface including one or more recesses capable of transferring an average quantity of toner material for each revolution of said roller ($Q_{rev}$) between said first and second regions;

a wiper configured to engage at least a portion of said roller surface;

wherein said wiper provides that the actual amount of toner transferred per revolution ($T_{rev}$) is equal to about 0.8-1.2 ($Q_{rev}$).

11. The cartridge of claim 10 wherein the amount of toner transferred per revolution ($T_{rev}$) is equal to about 0.9-1.1 ($Q_{rev}$).

12. The cartridge of claim 10 wherein said roller has a radius of curvature (Rc) and said recess includes a convex surface having a radius of curvature that is equal to about (0.75-5.0) (Rc).

13. The cartridge of claim 10 wherein said recess includes a recess surface and said wiper includes a body and upstanding flange wherein said upstanding flange engages with at least a portion of said roller surface and said recess convex surface.

14. The cartridge of claim 10 wherein said cartridge is located within a printer.

15. A method of transferring a quantity of toner comprising:

supplying a roller including one or more recesses capable of transferring an average quantity of toner for each revolution of said roller ($Q_{rev}$) between a first and second region wherein said recess includes a convex surface;

positioning a wiper to engage at least a portion of said roller; and rotating said roller wherein said wiper provides that the amount of toner transferred per roller revolution ($T_{rev}$) is equal to about 0.8-1.2($Q_{rev}$).

16. The method of claim 15 wherein the amount of toner transferred per roller revolution ($T_{rev}$) is equal to about 0.9-1.1($Q_{rev}$).

17. The method of claim 15 wherein said wiper includes a body and an upstanding flange wherein said upstanding flange engages with at least a portion of said roller.

18. The method of claim 17 wherein upon rotation of said roller, said upstanding flange provides a shearing force to toner on said roller.

19. The method of claim 15 wherein said first and second regions are located in a printer.

20. The method of claim 15 wherein said first and second regions are located in a printer cartridge.

* * * * *